US006923728B1

(12) United States Patent
Lin

(10) Patent No.: US 6,923,728 B1
(45) Date of Patent: Aug. 2, 2005

(54) GOLF CLUB FACE IMPACT ALIGNMENT DEVICE

(76) Inventor: Teh-Cheng Lin, 752 Pradera Way, San Ramon, CA (US) 94583

( * ) Notice: Subject to any disclaimer, the term of this patent is extended or adjusted under 35 U.S.C. 154(b) by 88 days.

(21) Appl. No.: 10/661,418

(22) Filed: Sep. 13, 2003

(51) Int. Cl.[7] ..... A63B 69/36
(52) U.S. Cl. ..... 473/220; 473/221; 473/257
(58) Field of Search ..... 473/219, 220, 473/221, 222, 223, 224, 225, 226, 257

(56) References Cited

U.S. PATENT DOCUMENTS 3,992,012 A * 11/1976 Campbell ..... 473/225
4,341,384 A 7/1982 Thackrey ..... 273/186 A
4,858,934 A * 8/1989 Ladick et al. ..... 473/220
5,330,188 A 7/1994 Reimers ..... 273/186.1
5,435,547 A * 7/1995 Lee ..... 473/225
5,692,966 A * 12/1997 Wash ..... 473/221
5,980,393 A 11/1999 Molinaroli et al. ..... 473/220
6,248,021 B1 * 6/2001 Ognjanovic ..... 473/131
6,334,785 B2 * 1/2002 Miwa ..... 439/272
6,669,574 B1 * 12/2003 Riley et al. ..... 473/264
6,702,690 B1 * 3/2004 Albright ..... 473/265
6,736,735 B2 * 5/2004 Galanis et al. ..... 473/221

* cited by examiner

*Primary Examiner*—Gregory Vidovich
*Assistant Examiner*—Nini F. Legesse
(74) *Attorney, Agent, or Firm*—Donald J. Ersler

(57) ABSTRACT

A golf club face impact alignment device includes a light emitting unit and a light sensing unit. The light emitting unit includes a first light emitting device, a second light emitting device, a power source and an emitting case. The first and second light emitting devices and the power source are retained in the emitting housing. The light emitting unit is attached to the club face of a golf club. The light sensing unit includes a first sensing unit, a second sensing unit and a base. The first and second sensing units are secured to the base. Each sensing unit preferably includes at least one photocell and a sensing case. The golf club is swung between the first and second sensing units. Light emitting from each end of the light emitting unit must be detected by the first and second light sensing units to activate an indication device.

20 Claims, 10 Drawing Sheets

GOLF CLUB FACE IMPACT ALIGNMENT DEVICE

BACKGROUND OF THE INVENTION

1. Field of the Invention

The present invention relates generally to golf clubs and more specifically to a golf club face impact alignment device, which aids a golfer in aligning the club face perpendicular to the golf ball desired path of travel.

2. Discussion of the Prior Art

There are several devices in the prior art which help a golfer strike a golf ball with the club face perpendicular to the desired path of travel. U.S. Pat. No. 4,341,384 to Thackrey discloses a golf swing diagnostic apparatus. U.S. Pat. No. 5,330,188 to Reimers discloses a putter alignment system. U.S. Pat. No. 5,980,393 to Molinaroi et al. discloses a golf club with laser system. However, none of these devices disclose a golf club face impact alignment device, which allows the golfer to know when they have struck the golf ball perpendicular to the desired path of travel.

Accordingly, there is a clearly felt need in the art for a golf club face impact alignment device, which allows golfers of varying skill level to practice striking the golf ball, such that the club face is perpendicular to the golf ball desired path of travel.

SUMMARY OF THE INVENTION

The present invention provides a golf club face impact alignment device, which ensures that the golf ball travels in a desired path. The golf club face impact alignment device (club face alignment device) includes a light emitting unit and a light sensing unit. The light emitting unit includes a first light emitting device, a second light emitting device, a power source and an emitting case. The emitting case includes an emitting housing and a back plate. The first and second light emitting devices and the power source are retained in the emitting housing. Preferably, a power plate makes an electrical connection between the power source, the first light emitting device and the second light emitting device. The power plate is retained between the emitting housing and the back plate. The light emitting unit is preferably attached to the club face with at least one fastener, but other attachment methods may also be used, such as double side tape or attachment clips.

The light sensing unit includes a first sensing unit, a second sensing unit and a base. The base preferably has a substantial C-shape. The first sensing unit is secured to one end of the base and the second sensing unit is secured to the other end of the base. Each sensing unit preferably includes at least one photocell and a sensing case. Each sensing case includes a sensing housing and a sensing cover plate. A slot lens is inserted before the at least one photocell to ensure correct alignment of a light beam from light emitting unit. An indication device is retained in one of the sensing units and could be a light indication or a sound indication. At least one power source is used to provide power to the first and second light sensing units.

The light emitting unit is secured to a golf club face. The golf club is swung between the first and second sensing units. The at least one photocell of the first and second light sensing units must face each other. Light emitting from each end of the light emitting unit must be detected by the first and second light sensing units, simultaneously. If the light is detected by only one of the two light sensing units, then the golf club face is not properly aligned; when golf club is swung, the ball will take a path different than what the golfer desires. When both light sensing units detect light simultaneously, the golf ball will follow the desired path of the golfer. A sound or light indicator will also be activated.

Accordingly, it is an object of the present invention to provide a club face alignment device, which allows golfers to practice striking a golf ball, such that the club face is perpendicular to the desired path of the golf ball.

These and additional objects, advantages, features and benefits of the present invention will become apparent from the following specification.

DETAILED DESCRIPTION OF THE PREFERRED EMBODIMENTS

Figures 1, 1A:
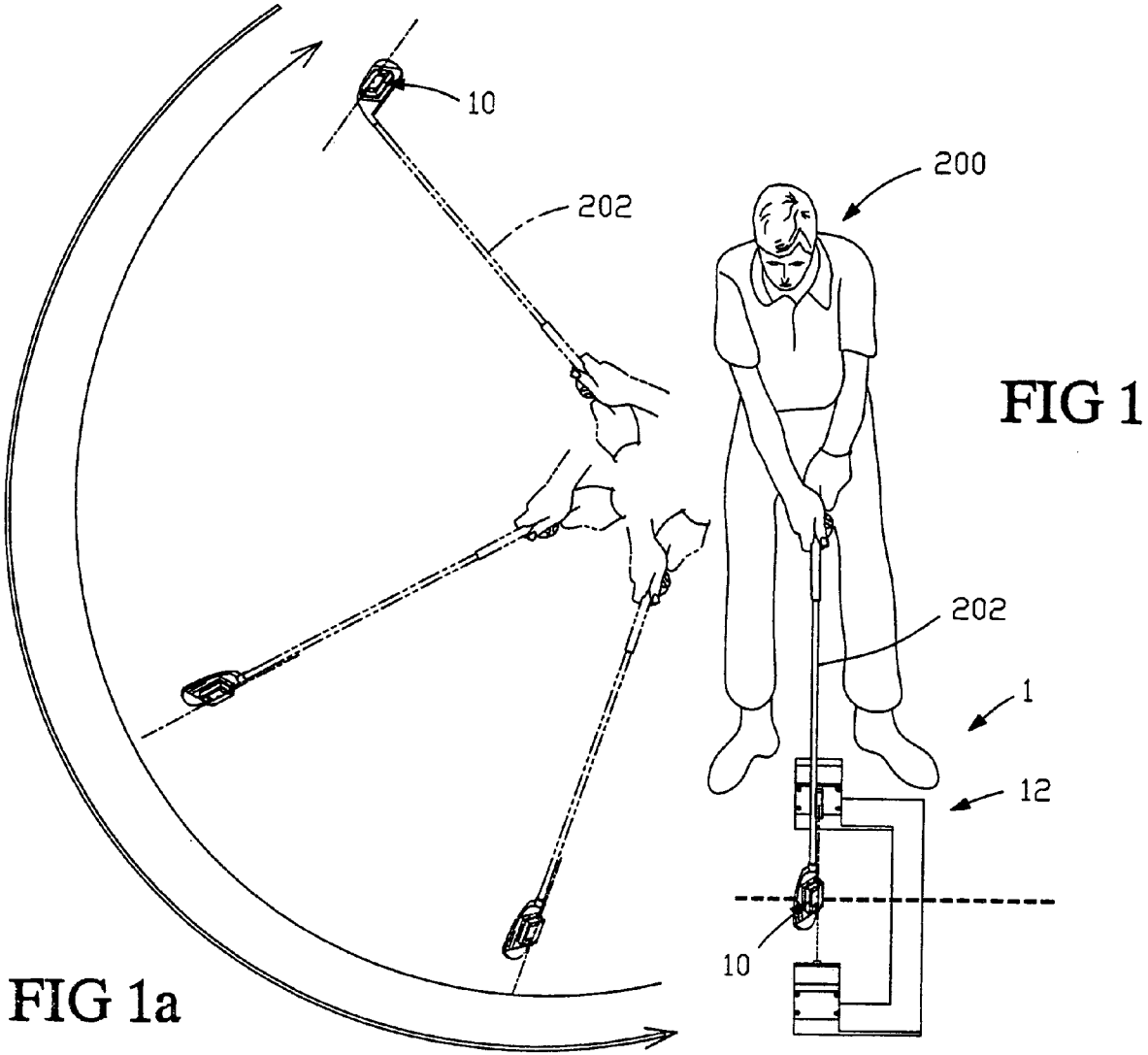
FIG. 1 is a front perspective view of a golfer utilizing a club face alignment device in accordance with the present invention.
FIG. 1*a* is an enlarged front perspective view of a golf club being swung by a golfer with a light emitting unit attached to the club face of a club face alignment device in accordance with the present invention.
Figures 7, 8:
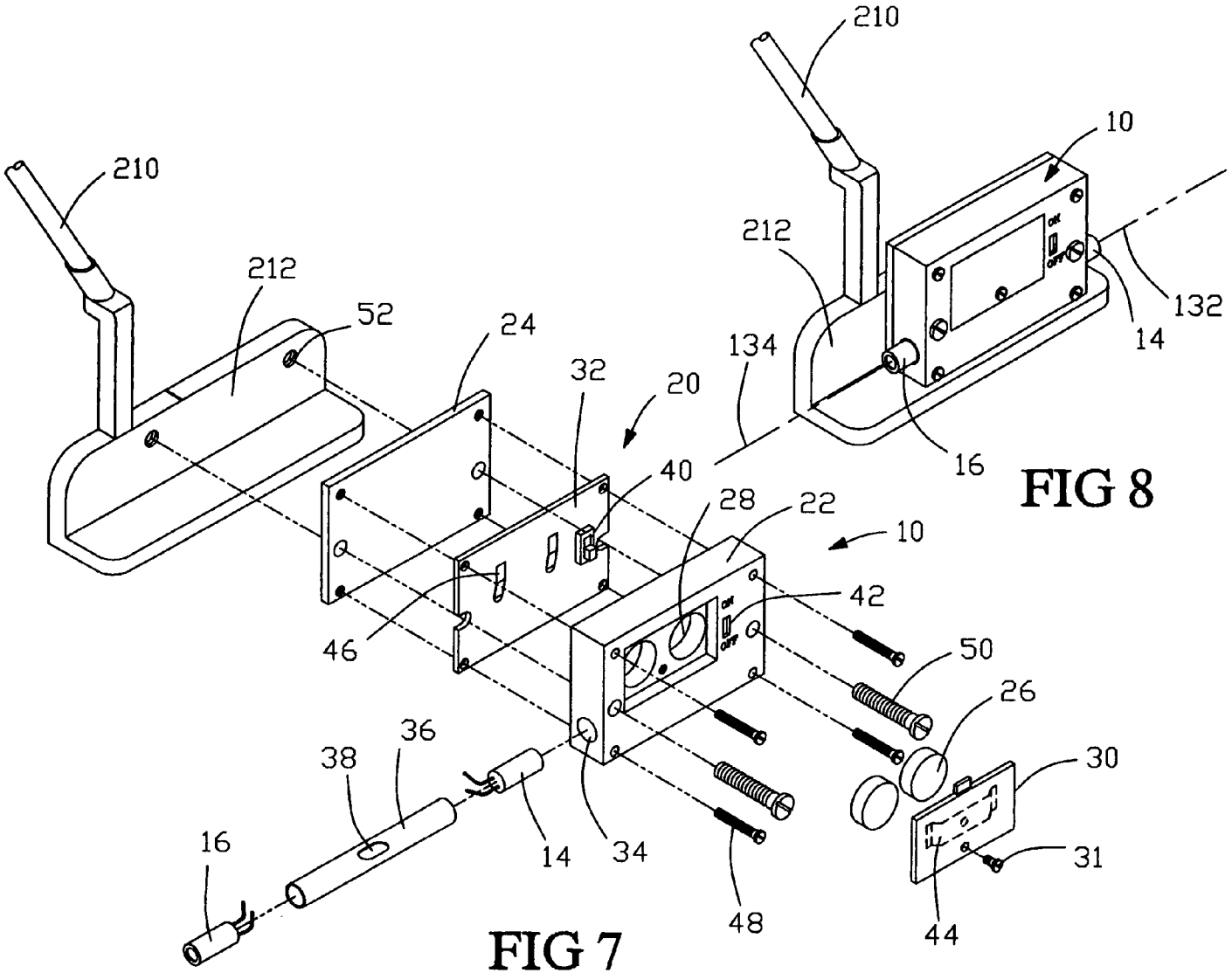
FIG. 7 is an exploded perspective view of a light emitting unit of a club face alignment device in accordance with the present invention.
FIG. 8 is a perspective view of a light emitting unit attached to a back side of a club face of a putter in accordance with the present invention.
Figures 9, 10:
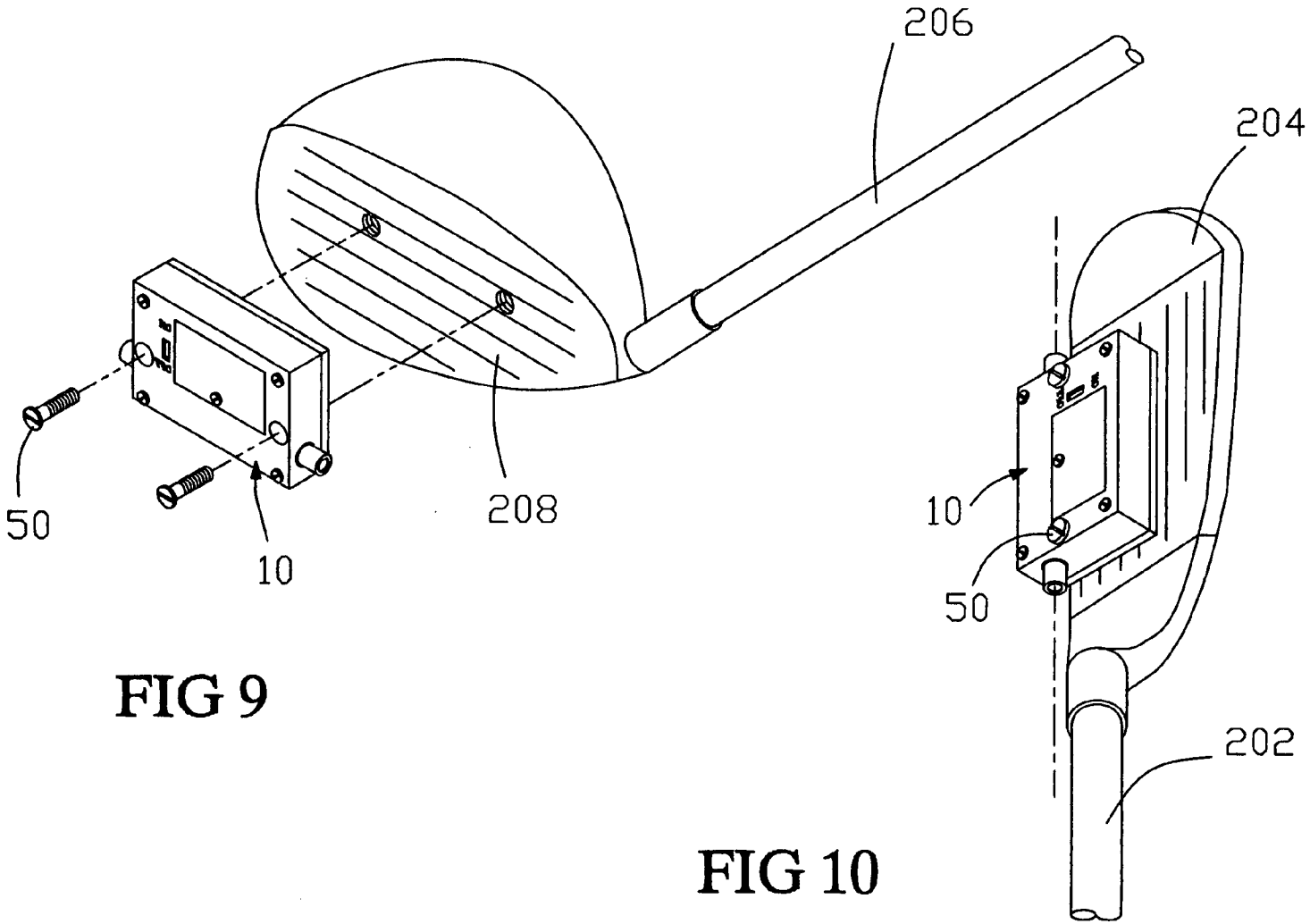
FIG. 9 is a partially exploded perspective view of a light emitting unit relative to a club face of a wood golf club in accordance with the present invention.
FIG. 10 is a perspective view of a light emitting unit attached to a club face of an iron golf club in accordance with the present invention.

With reference now to the drawings, and particularly to FIG. 1, there is shown a perspective view of a golfer 200 utilizing a club face alignment device 1. The club face alignment device 1 includes a light emitting unit 10 and a light sensing unit 12. With reference to FIGS. 1*a* and 10, the light emitting unit 10 is attached to an iron club face 204 of a club 202 with screws 50, but other attachment methods may also be used, such as such as double sided tape or attachment clips. With reference to FIG. 9, the light emitting unit 10 is attached to a golf club 206 with a wood club face 208 with screws 50, but other attachment methods may also be used, such as such as double sided tape or attachment clips. With reference to FIGS. 7 and 8, the light emitting unit 10 includes a first light emitting device 14, a second light emitting device 16, a power source and an emitting case 20. Each light emitting device is preferably a light emitting diode, but other devices may also be used.

The first light emitting device 14 projections a first light beam 132 and the second light emitting device 16 projections a second light beam 134. The emitting case 20 includes an emitting housing 22 and a back plate 24. The power source is preferably at least one battery 26. The emitting housing 22 preferably includes at least one battery cavity 28 that is sized to receive the at least one battery 26. A battery cover 30 is used to retain the at least one battery 26. At least one battery fastener 31 is used to secure the battery cover 30 to the emitting housing 22.

Preferably, a power plate 32 makes an electrical connection, between the at least one battery 26, the first light emitting device 14 and the second light emitting device 16. A through opening 34 is formed through the emitting housing 22 to receive the first and second light emitting devices and a spacer tube 36. A lead opening 38 is formed through a wall of the spacer tube 36 to provide clearance for the leads of the first and second light emitting devices. The spacer tube 36 orients the first and second light emitting devices to be at the ends of the through opening 34. The first and second light emitting devices are preferably secured to the ends of the through opening 34 with an adhesive or the like.

An on-off switch 40 is retained on the power plate 32 and a switch opening 42 is formed through the emitting housing 22 to receive the on-off switch 40. A shorting strip 44 is preferably attached to a back side of the battery cover 30 to electrically connect the two batteries 26 in series. Two electrical clips 46 extend from the power plate 32 to electrical contact with the two batteries 26. At least one fastener 48 is preferably used to assemble the emitting housing 22, power plate 32 and back plate 24, but other assembly methods may also be used. At least one attachment fastener 50 is screwed into at least one threaded hole 52 formed in a back side of the putter club face 212, but other assembly methods may also be used, such as double sided tape or attachment clips.

Figure 2:
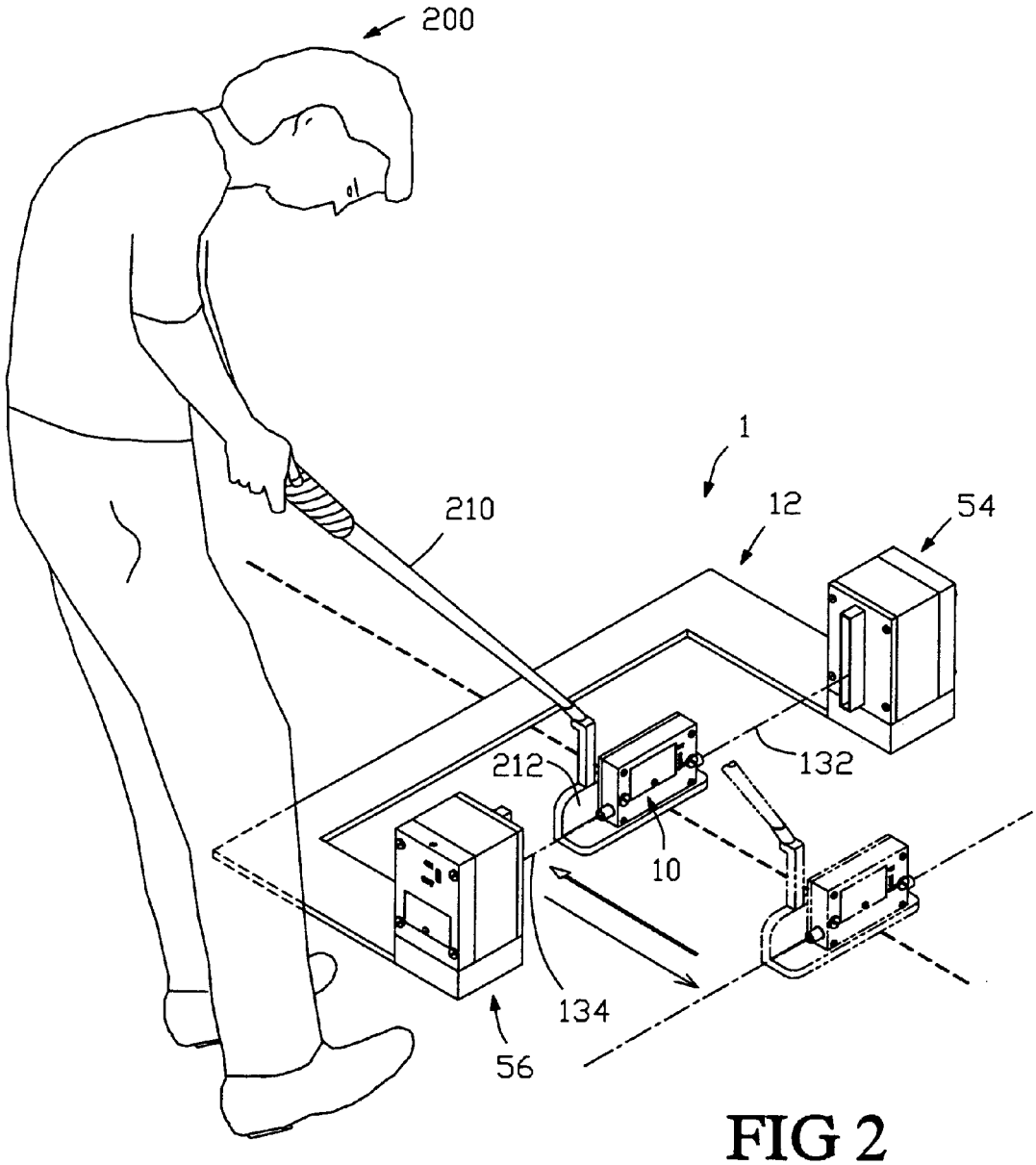
FIG. 2 is a perspective view of a golf club extending from a golfer's hands with a light emitting unit attached to a back side of a club face aligned with a light sensing unit of a club face alignment device in accordance with the present invention.
Figure 4:
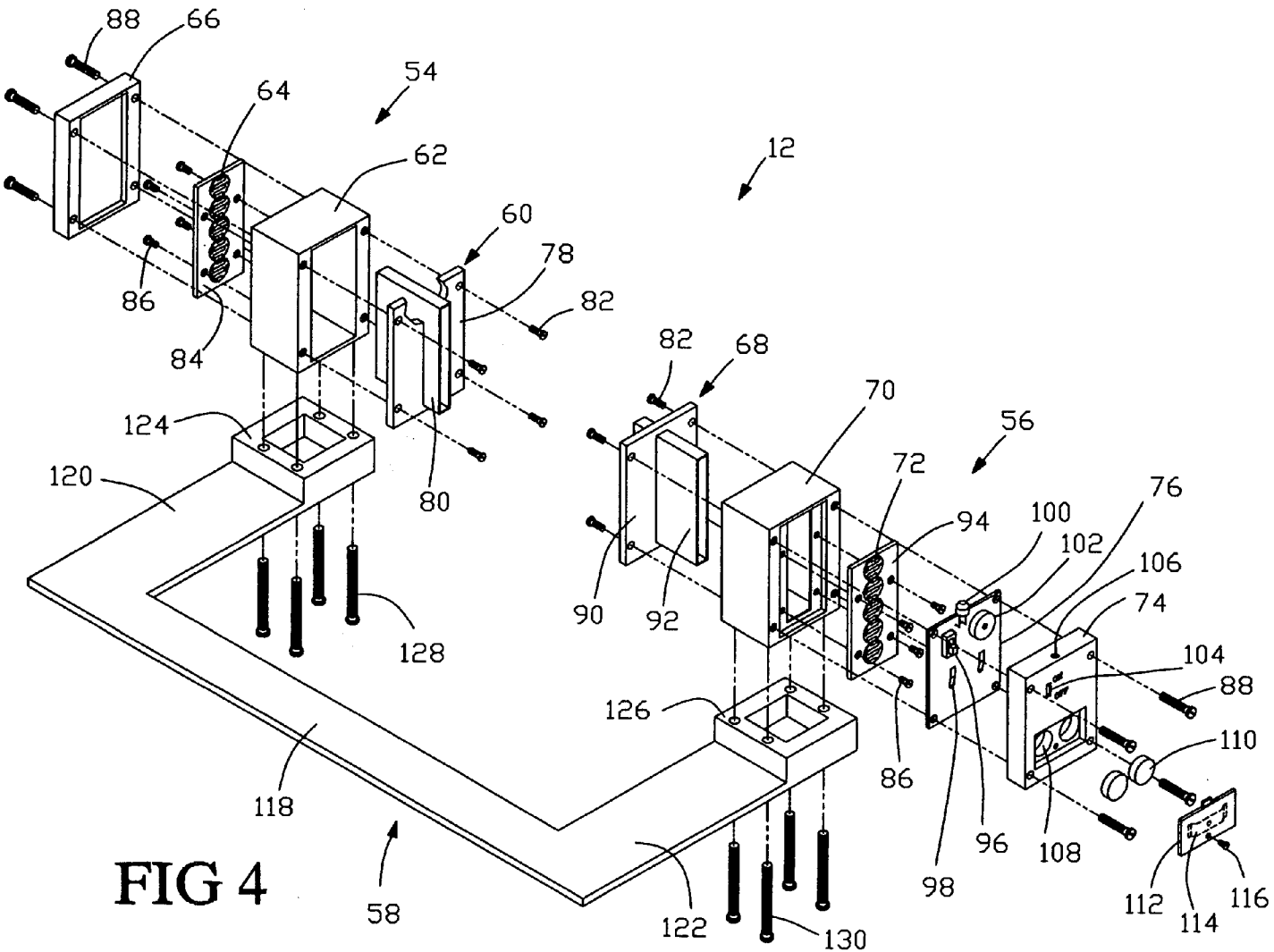
FIG. 4 is an exploded perspective view of a light sensing unit of a club face alignment device in accordance with the present invention.
Figure 5:
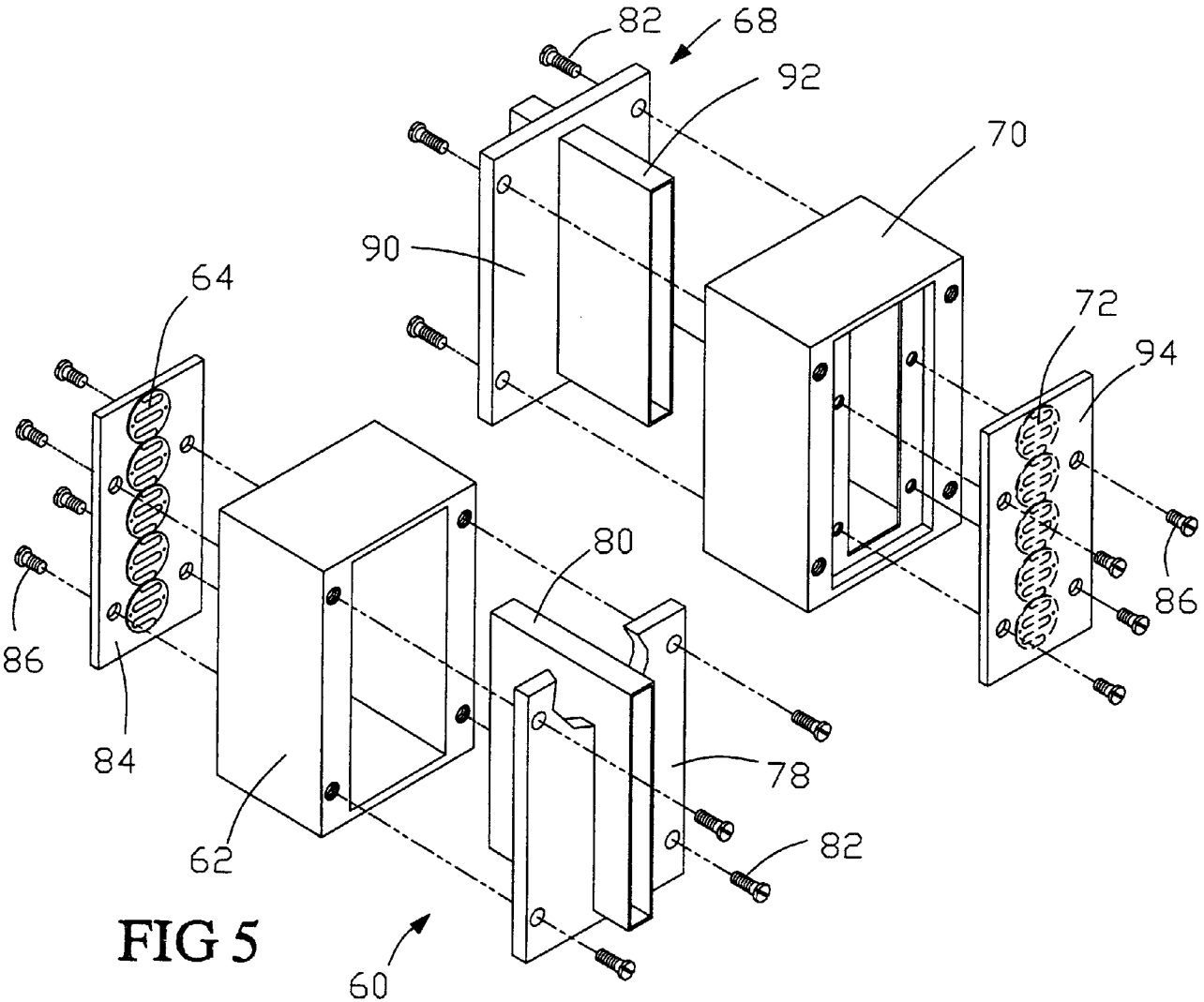
FIG. 5 is a partially exploded perspective view of a first and second sensing unit of a club face alignment device in accordance with the present invention.
Figure 6:
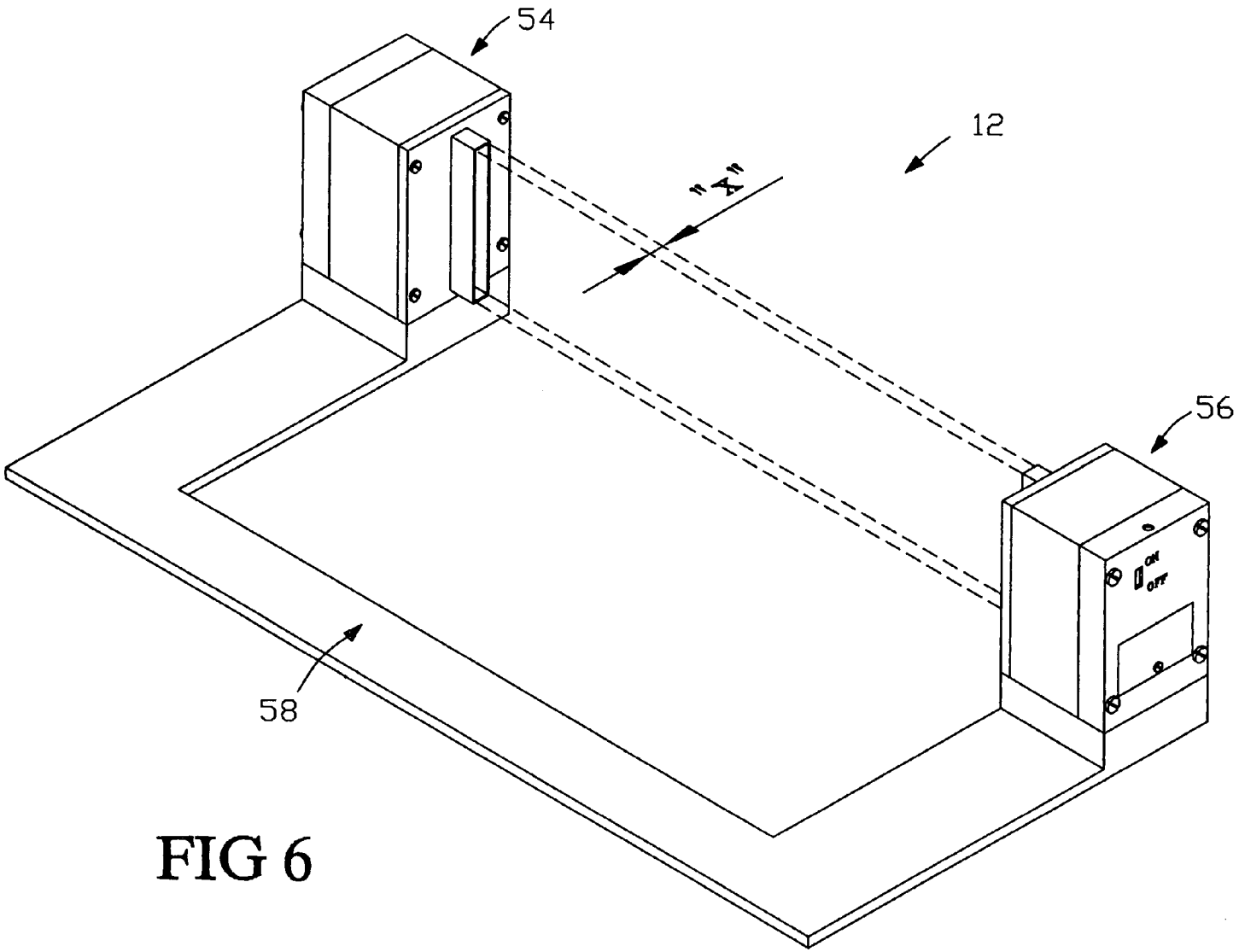
FIG. 6 is a perspective view of a light sensing unit of a club face alignment device in accordance with the present invention.

With reference to FIGS. 4–5, the light sensing unit 12 includes a first sensing unit 54, a second sensing unit 56 and a base 58. The base 58 has a substantial C-shape. With reference to FIG. 2, the golfer 200 is swinging a putter 210 with the light emitting unit 10 mounted to a back side of the club face 212 thereof. The putter 210 is swung between the first and second sensing units, such that the first light beam 132 is received by the first sensing unit 54 and the second light beam 134 is received by the second sensing unit 56. The first sensing unit 54 preferably includes a first lens 60, a first sensing housing 62, at least one first photocell 64 and a first sensing cover plate 66. The second sensing unit 56 preferably includes a second lens 68, a second sensing housing 70, at least one second photocell 72 and a second sensing cover plate 74. An indicator plate 76 may be retained in the first or second sensing units. The first lens 60 includes a first fastening plate 78 and a first slot lens 80. The first slot lens 80 is a rectangular tube, which requires precise alignment from the light emitting unit 10. The first lens 60 is preferably secured to one side of the first sensing housing 62 with at least one fastener 82, but other attachment methods may also be used. The at least one first photocell 64 is retained on a first photocell plate 84. The first photocell plate 84 is preferably secured to the other end side of the first sensing housing 62 with at least one fastener 86, but other attachment methods may also be used. The first sensing cover plate 66 is preferably secured to the other side of the first sensing housing 62 with at least one fastener 88, but other attachment methods may also be used.

The second lens 68 includes a second fastening plate 90 and a second slot lens 92. The second slot lens 92 is a rectangular tube, which requires precise alignment from the light emitting unit 10. The second lens 68 is preferably secured to one side of the second sensing housing 70 with at least one fastener 82. The at least one second photocell 72 is retained on a second photocell plate 94. The second photocell plate 94 is preferably secured to one side of the second sensing housing 70 with at least one fastener 86. The indicator plate 76 preferably includes an on-off switch 96, two electrical clips 98, a light emitting device 100 and a sound emitting device 102; the indicator plate 76 includes the appropriate electrical connections for the previously identified items. The first and second slot lens prevent the first and second photocells from being activated by sun light. Preferably, the inside of the first and second slot lens do not reflect light to further prevent false triggering the light or sound emitting device.

The second sensing cover plate 74 includes an on-off opening 104, a light indicator opening 106 and at least one battery cavity 108. The on-off opening 104 is sized to receive the on-off switch 96. The light indicator opening 106 is sized to receive the light emitting device 100. The at least one battery cavity 108 is sized to receive at least one battery 110. A battery cover 112 is used to retain electrical contact between the at least one battery 110, the two electrical clips 98 and a shorting strip 114. The shorting strip 114 is attached to a back side of the battery cover 112. The shorting strip 114 makes an electrical connection between two adjacent batteries 110. At least one battery fastener 116 is preferably used to secure the battery cover 112 to the second sensing cover plate 74. The second sensing cover plate 74 is preferably secured to the other side of the second sensing housing 70 with at least one fastener 88.

The base 58 preferably includes a base leg 118, a first leg 120 and a second leg 122. The first leg 120 extends from a first end of the base leg 118 and the second leg 122 extends from a second end of the base leg 118. An end of the first leg 120 is preferably terminated with a first sensing base 124 and an end of the second leg 122 is preferably terminated with a second sensing base 126. The first sensing unit 54 is preferably secured to the first sensing base 124 with at least one fastener 128 and the second sensing unit 56 is preferably secured to the second sensing base 126 with at least one fastener 130.

Figure 16:
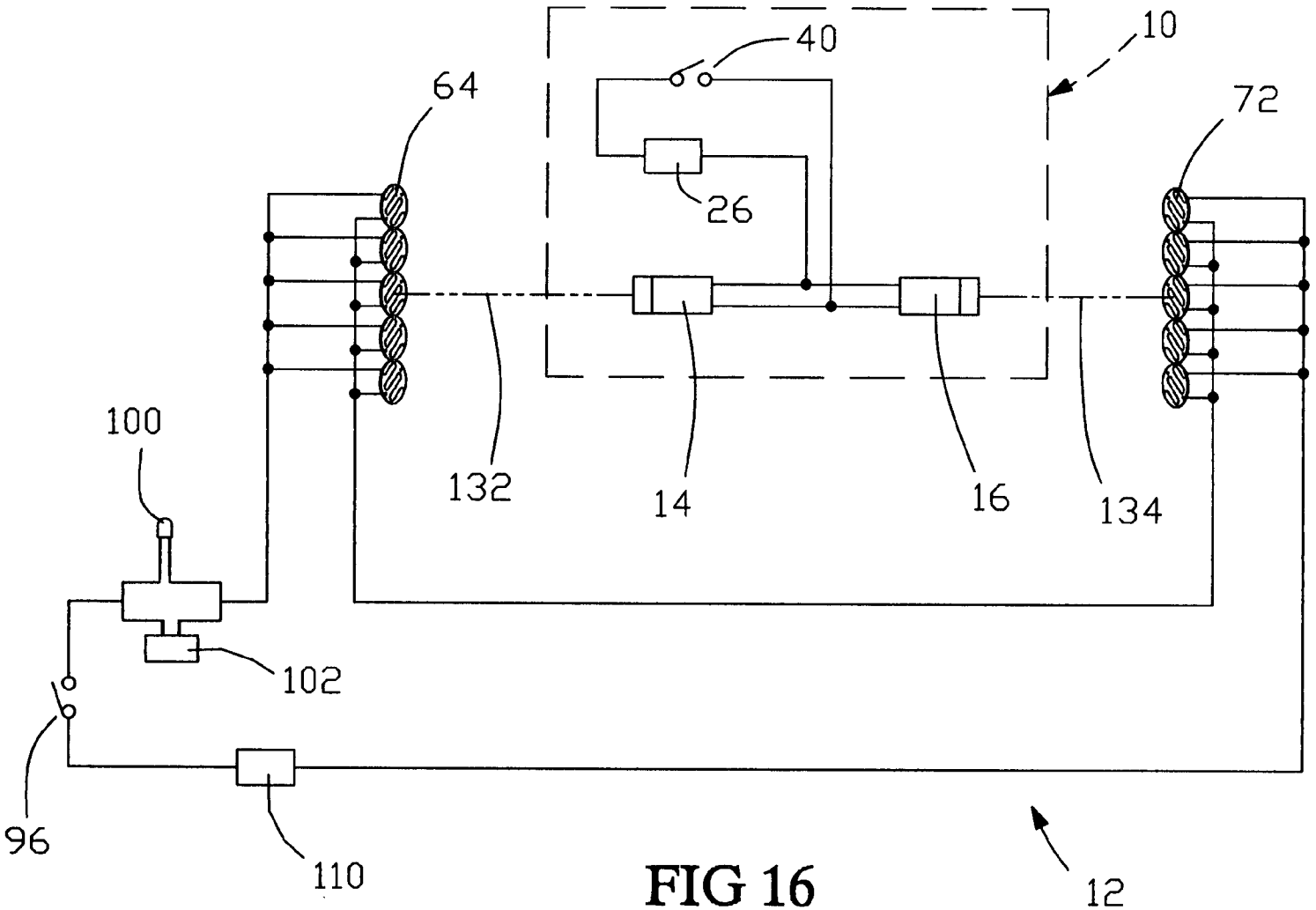
FIG. 16 is an electrical schematic of the club face alignment device in accordance with the present invention.

FIG. 16 discloses an electrical schematic of the light emitting unit 10, the light sensing unit 12 and an optical interaction therebetween. The light emitting unit 10 is activated by placing the on-off switch 40 in an "on" position. The at least one battery 26 supplies power to the first and second light emitting devices, when the on-off switch 40 is in the "on" position. The light sensing unit 12 is activated by placing the on-off switch 96 in an "on" position. The at least one battery 110 supplies power to the light emitting device 100 and to the sound emitting device 102, when the on-off switch is in the "on" position and when both the first and second photocells are closed. The first and second photocells close, when thereof see the first light beam 132 and the second light beam 134 from the first and second light emitting devices, respectively. The first and second light emitting devices are connected in parallel, therefore only one first and one second photocell need close to activate an audible alert from the sound emitting device 102 and a visual alert from the light emitting device 100.

Figure 3:
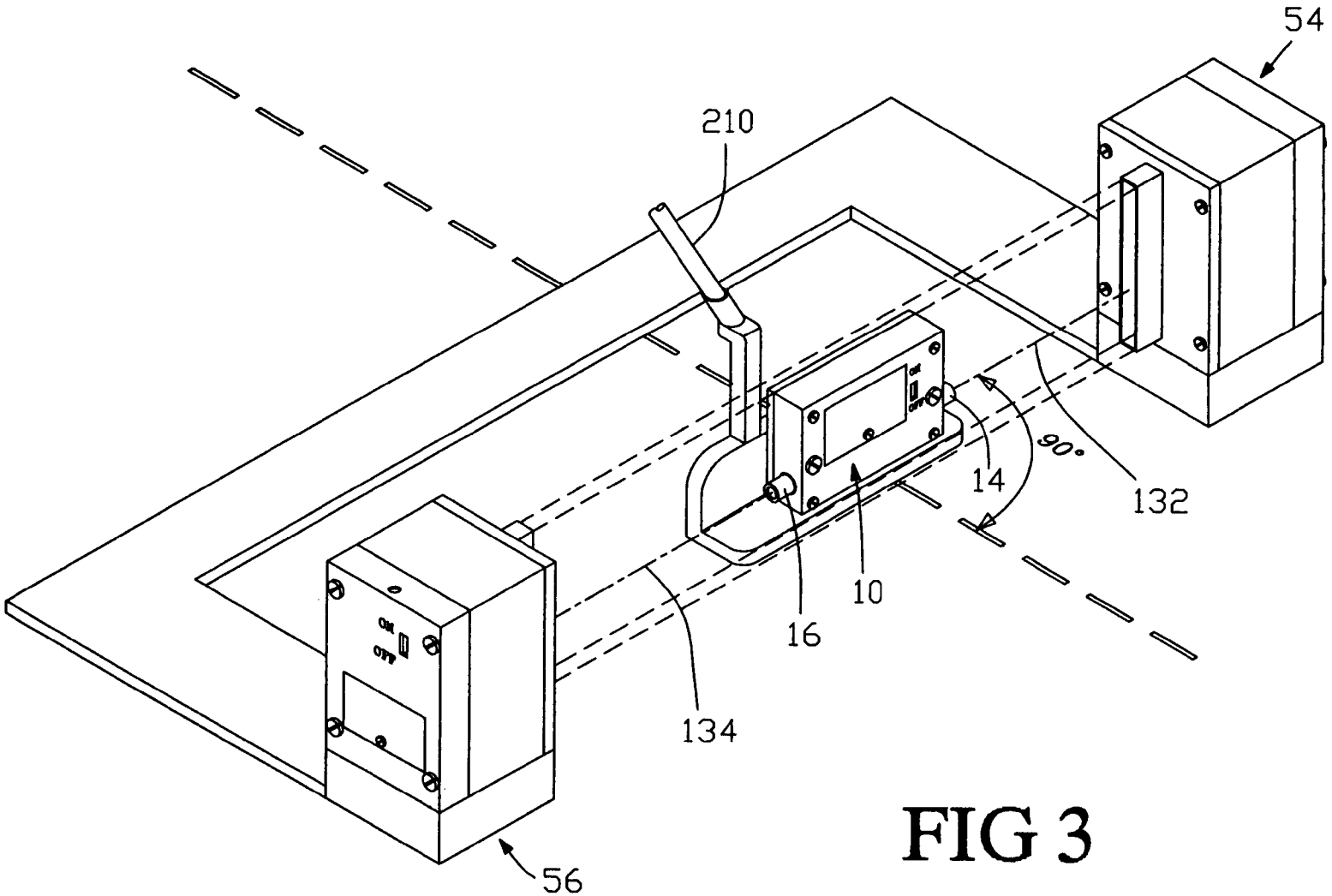
FIG. 3 is a perspective view of a light emitting unit attached to a back side of a club face aligned with a light sensing unit of a club face alignment device in accordance with the present invention.
Figure 11:
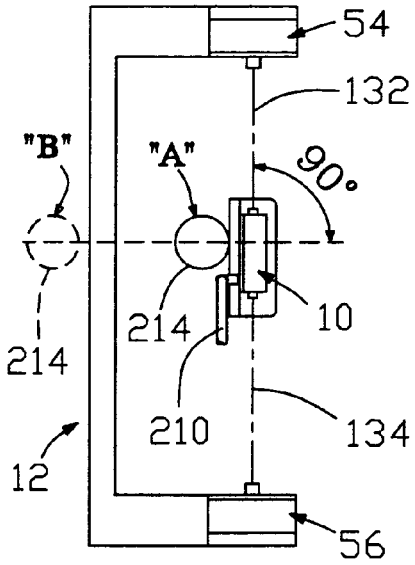
FIG. 11 is a top plan view of a club face alignment device with a light emitting unit attached to a back side of a putter club face and properly aligned with a light sensing unit in accordance with the present invention.
Figure 12:
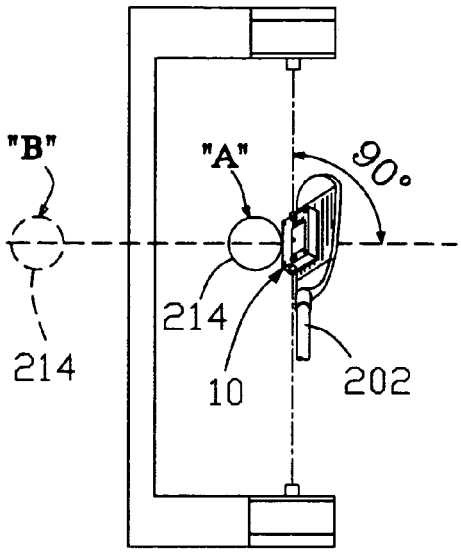
FIG. 12 is a top plan view of a club face alignment device with a light emitting unit attached to an iron club face and properly aligned with a light sensing unit in accordance with the present invention.

With reference to FIGS. 3, 6 and 11–15, the golf club 210 is swung between the first and second sensing units. The wider the width "X" of each first and second slot lens, the greater the angle of error can be, when a golfer 200 swings the golf club 210. In FIGS. 3 & 11, the light emitting unit 10 is aligned at 90 degrees to the intended path of travel. The first and second light beams will be seen by the photocells in the first and second sensing units. When the golf ball 214 is struck, it will move from position A to position B. In FIG. 12, the light emitting unit 10 is aligned at 90 degrees to the intended path of travel. The first and second light beams will be seen by the photocells in the first and second sensing units. When the golf ball 214 is struck by golf club 202, it will move from position A to position B. In both FIGS. 11 and 12, both the light and sound emitting devices will activate to tell the golfer that the club face alignment was proper.

Figure 13:
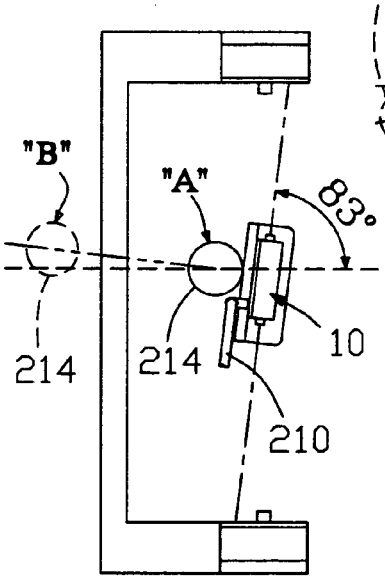
FIG. 13 is a top plan view of a club face alignment device with a light emitting unit attached to a back side of a putter club face and with neither light emitting device sensed by the first and second sensing units in accordance with the present invention.

In FIG. 13, the light emitting unit 10 is aligned at 83 degrees to the intended path of travel. The first and second light beams will be seen by the photocells of the first and second sensing units at different times. Therefore, the light and sound emitting devices will not be activated. When the golf ball 214 is struck by the golf club 210, it will move from position A to position B, which is not the intended path of travel for golf ball 214.

Figure 14:
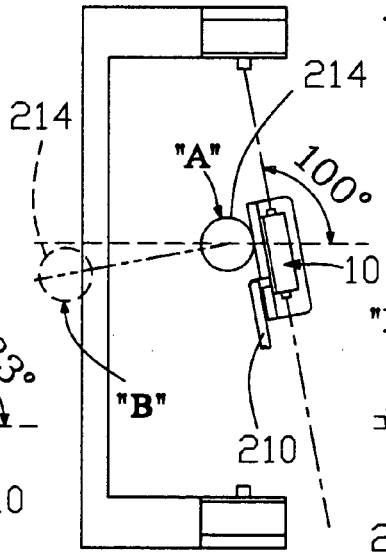
FIG. 14 is a top plan view of a club face alignment device with a light emitting unit attached to a back side of a putter club face and with a first light emitting device not sensed by the first sensing unit, the club face being at an obtuse angle to the desired golf ball path in accordance with the present invention.

In FIG. 14, the light emitting unit 10 is aligned at 100 degrees to the intended path of travel. The first and second light beams will not be seen by the photocells of the first and second sensing units, because the angle of error is too great. The first and second slot lens will prevent the first and second light beams from traveling to the first and second photocells (assuming that the insides of the first and second slot lens do not reflect light). Therefore, the light and sound emitting devices will not be activated. When the golf ball 214 is struck by the golf club 210, it will move from position A to position B, which is not the intended path of travel for golf ball 214.

Figure 15:
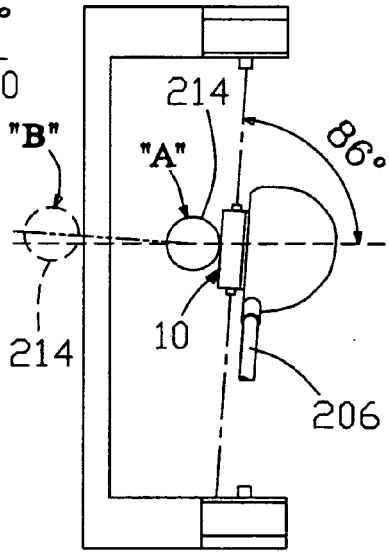
FIG. 15 is a top plan view of a club face alignment device with a light emitting unit attached to a wood club face and with a first light emitting device sensed by the first sensing unit, the club face being at an acute angle to the desired ball path in accordance with the present invention.

In FIG. 15, the light emitting unit 10 is aligned at 86 degrees to the intended path of travel. The first and second light beams will be seen by the photocells of the first and second sensing units at different times. Therefore, the light and sound emitting devices will not be activated. When the golf ball 214 is struck by the golf club 206, it will move from position A to position B, which is not the intended path of travel for golf ball 214.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of locating a club face of a golf club perpendicular to the intended golf ball path of travel, comprising the steps of:

attaching a light emitting unit to the club face of the golf club, said light emitting unit emitting a first beam of light and a second beam of light;

providing a first light sensing unit and a second light sensing unit, positioning said first light sensing unit to receive said first beam of light, positioning said second light sensing unit to receive said second beam of light;

swinging the club face of the golf club between said first and second light sensing units; and providing an indication when said first and second light beams are detected by said first and second sensing units simultaneously.

2. The method of locating a club face of a golf club perpendicular to the intended path of travel of claim 1, further comprising the step of:

providing said light emitting unit with a first light emitting device and a second light emitting device, said first light emitting device providing said first beam of light, said second light emitting device providing said second beam of light.

3. The method of locating a club face of a golf club perpendicular to the intended path of travel of claim 2, further comprising the step of:

positioning said first light emitting device substantially opposite said second light emitting device.

4. The method of locating a club face of a golf club perpendicular to the intended path of travel of claim 1, further comprising the step of:

providing said first light sensing unit with at least one first photocell and said second light sensing unit with at least one second photocell.

5. The method of locating a club face of a golf club perpendicular to the intended path of travel of claim 4, further comprising the step of:

placing a first slot lens in front of said at least one first photocell and a second slot lens in front of said at least one second photocell.

6. The method of locating a club face of a golf club perpendicular to the intended path of travel of claim 1, further comprising the step of:

providing an audible alert with a sound emitting device, when said first and second light beams are detected by said first and second sensing units simultaneously.

7. The method of locating a club face of a golf club perpendicular to the intended path of travel of claim 1, further comprising the step of:

providing a visual alert with a light emitting device, when said first and second light beams are detected by said first and second sensing units simultaneously.

8. The method of locating a club face of a golf club perpendicular to the intended path of travel of claim 1, further comprising the step of:

retaining said first light sensing unit on a first end of a base and retaining said second light sensing unit on a second end of said base.

9. A method of locating a club face of a golf club perpendicular to the intended golf ball path of travel, comprising the steps of:

attaching a light emitting unit to the club face of the golf club, said light emitting unit including a first light emitting device and a second light emitting device, a first beam of light being projected from said first light emitting device and a second beam of light being projected from said second light emitting device;

providing a first light sensing unit and a second light sensing unit, positioning said first light sensing unit to receive said first beam of light, positioning said second light sensing unit to receive said second beam of light;

swinging the club face of the golf club between said first and second light sensing units; and providing an indication when said first and second light beams are detected by said first and second sensing units simultaneously.

10. The method of locating a club face of a golf club perpendicular to the intended path of travel of claim 9, further comprising the step of:

providing said first light sensing unit with at least one first photocell and said second light sensing unit with at least one second photocell.

11. The method of locating a club face of a golf club perpendicular to the intended path of travel of claim 10, further comprising the step of:

placing a first slot lens in front of said at least one first photocell and a second slot lens in front of said at least one second photocell.

12. The method of locating a club face of a golf club perpendicular to the intended path of travel of claim 9, further comprising the step of:

providing an audible alert with a sound emitting device, when said first and second light beams are detected by said first and second sensing units simultaneously.

13. The method of locating a club face of a golf club perpendicular to the intended path of travel of claim 9, further comprising the step of:

providing a visual alert with a light emitting device, when said first and second light beams are detected by said first and second sensing units simultaneously.

14. The method of locating a club face of a golf club perpendicular to the intended path of travel of claim 9, further comprising the step of:

retaining said first light sensing unit on a first end of a base and retaining said second light sensing unit on a second end of said base.

15. The method of locating a club face of a golf club perpendicular to the intended path of travel of claim 9, further comprising the step of:

positioning said first light emitting device substantially opposite said second light emitting device.

16. A method of locating a club face of a golf club perpendicular to the intended golf ball path of travel, comprising the steps of:

attaching a light emitting unit to the club face of the golf club, said light emitting unit including a first light emitting device and a second light emitting device, a first beam of light being projected from said first light emitting device and a second beam of light being projected from said second light emitting device;

providing a first light sensing unit and a second light sensing unit, said first light sensing unit including at least one first photocell, said second light sensing unit including at least one second photocell, positioning said at least one first photocell to receive said first beam of light, positioning said at least one second photocell to receive said second beam of light;

placing a first slot lens in front of said at least one first photocell and a second slot lens in front of said at least one second photocell;

swinging the club face of the golf club between said first and second light sensing units; and providing an indication when said first and second light beams are detected by said first and second sensing units simultaneously.

17. The method of locating a club face of a golf club perpendicular to the intended path of travel of claim 16, further comprising the step of:

providing an audible alert with a sound emitting device, when said first and second light beams are detected by said first and second sensing units simultaneously.

18. The method of locating a club face of a golf club perpendicular to the intended path of travel of claim 16, further comprising the step of:

providing a visual alert with a light emitting device, when said first and second light beams are detected by said first and second sensing units simultaneously.

19. The method of locating a club face of a golf club perpendicular to the intended path of travel of claim 16, further comprising the step of:

retaining said first light sensing unit on a first end of a base and retaining said second light sensing unit on a second end of said base.

20. The method of locating a club face of a golf club perpendicular to the intended path of travel of claim 16, further comprising the step of:

positioning said first light emitting device substantially opposite said second light emitting device.

* * * * *